United States Patent [19]

Shapiro

[11] Patent Number: 4,884,060

[45] Date of Patent: Nov. 28, 1989

[54] MULTI-STATE SELECTION SWITCH FOR A PERSONAL EMERGENCY RESPONSE SYSTEM

[75] Inventor: L. Dennis Shapiro, Chestnut Hill, Mass.

[73] Assignee: Lifeline Systems, Inc., Watertown, Mass.

[21] Appl. No.: 290,469

[22] Filed: Dec. 27, 1988

[51] Int. Cl.[4] ..... G08B 29/00

[52] U.S. Cl. ..... 340/514; 340/539; 340/531; 340/825.06; 340/825.69; 340/825.72; 379/29

[58] Field of Search ..... 340/514, 539, 531, 825.72, 340/825.69, 825.06, 825.36; 379/29

[56] References Cited

U.S. PATENT DOCUMENTS

| | | | |
|---|---|---|---|
| 3,925,763 | 12/1975 | Wadhwani et al. | 340/539 |
| 3,989,900 | 11/1976 | Dibner . | |
| 4,064,368 | 12/1977 | Dibner . | |
| 4,092,643 | 5/1978 | Stolarezyk | 340/539 |
| 4,308,911 | 1/1982 | Mandl | 340/506 |
| 4,446,454 | 5/1984 | Pyle | 340/531 |
| 4,491,970 | 1/1985 | LaWhite et al. | 455/100 |
| 4,524,243 | 6/1985 | Shapiro . | |
| 4,536,747 | 8/1985 | Jensen | 340/531 |
| 4,656,319 | 4/1987 | Bially | 379/29 |

*Primary Examiner*—Donnie L. Crosland

*Attorney, Agent, or Firm*—Weingarten, Schurgin, Gagnebin & Hayes

[57] ABSTRACT

A multi-state selection switch for a personal emergency response system which permits selective operation of the system in HOME or AWAY modes. In the HOME mode, a subscriber unit located in a remote subscriber station is activated by a subscriber using either a portable or wired-in activator to transmit an alarm message to a central station via an interconnecting communications link. In the AWAY mode, the subscriber unit is inhibited from activation as a personal emergency response system by the protable activator and may be interfaced with one or more funtional subsystems of the remote subscriber station and operative to perform one or more predetermined regulating and/or monitoring functions in combination with the corresponding interfaced subsystems. The subscriber unit in the AWAY mode may be operative to transmit status messages to the cnetral station. Also, while the system is in the AWAY mode, the portable activator can be used for command or control purposes without causing an alarm to be transmitted. Upon return of the subscriber to the remote subscriber to temporarily deactivate the subscriber unit, thereby permitting the subscriber to enter the remote subscriber station and selectively switch the subscriber unit to the HOME mode.

16 Claims, 1 Drawing Sheet

MULTI-STATE SELECTION SWITCH FOR A PERSONAL EMERGENCY RESPONSE SYSTEM

RELATED APPLICATION

This application is related to U.S. patent application entitled APPARATUS AND METHOD FOR REPORTING VERIFICATION TESTIN OF A PERSONAL EMERGENCY RESPONSE SYSTEM (LIFE-012XX), filed concurrently with the present application.

FIELD OF THE INVENTION

This invention relates generally to personal emergency response systems, and more particularly to a multi-state selection switch which permits the system to be selectively operated in HOME or AWAY modes.

BACKGROUND OF THE INVENTION

Personal emergency response systems are known in the art. Representative examples of such systems are disclosed in U.S. Pat. Nos. 4,656,319, 4,524,243, 4,064,368 and 3,989,900, owned by the assignee of the present application. The personal emergency response system includes a central station and one or more remote subscriber stations such as at a residence or business interconnected therewith.

The central station may be any facility such as a hospital, a police station, a fire station, a phone answering service or a burglary alarm monitoring service which responds to alarm messages generated by remote subscriber stations to provide assistance thereto. The central station is interconnected with the remote subscriber stations via communication links.

Various communication links may be utilized to interconnect the central station with remote subscriber stations including telephone communication lines, cable television transmission lines, radio frequency transmissions or dedicated land lines. Typically, telephone communication lines are utilized due to the prevalence of in-place telephone networks and the minimal expense necessary to interface a personal emergency response system with a telephone network.

Each remote subscriber station includes a subscriber unit interfaced with the communications link. Upon activation of the subscriber unit in response to a predetermined event, an alarm message is transmitted via the communications link to the central station.

Various means may be utilized to activate the subscriber unit to transmit an alarm message. The subscriber unit may include a timing/logic circuit which is operative to automatically activate the unit upon expiration of a predetermined period of time. A subscriber unit of this type will also include a subscriber-activated reset means which reinitializes the timing/logic circuit. The reset means may be interfaced with any device frequently used by the subscriber such as electrical switches, television sets, radios, refrigerators, stoves or telephones wherein the use of any such device causes the timing circuit to be reset to zero.

The subscriber unit may also be activated by an activator hard-wired into the subscriber unit. The wired-in activator may be part of the subscriber unit or disposed remote from the subscriber unit in one or more locations at the subscriber station.

The subscriber unit may also be activated by means of a portable activator carried by the subscriber. A portable activator is particularly useful to elderly or infirm subscribers who may be prone to acute emergencies requiring an immediate response. The portable activator also has utility for notifying the central station of an event such as a fire or an intruder in the remote subscriber station. When immediate assistance is required by the subscriber, the portable activator is manually operated to activate the system.

The portable activator is typically a wireless unit which transmits an uncoded or coded signal to activate the subscriber unit located within the remote subscriber station. Most commonly, the portable activator is a radio transmitter, although infrared and ultrasonic transmitters may also be used.

The subscriber unit of a typical personal emergency response system is a technically sophisticated device which includes a receiving unit for reception of the coded or uncoded activating signal transmitted by the portable activator, a control unit such as a microprocessor operative in response to the activating signal to implement the functions of the subscriber unit, and a transmitter subassembly activated by the control unit to transmit alarm messages to the central station. Typically, the subscriber unit includes one or more timing/logic circuits which clock one or more predetermined intervals of time and activate the control unit to perform predetermined functions upon elapse of the predetermined time intervals.

The personal emergency response system discussed in the preceding paragraphs is designed to be operative only when the subscriber is present in the remote subscriber station. Pragmatically, it makes little sense for the subscriber unit of a typical personal emergency response system to transmit an alarm message when the subscriber is absent from the remote subscriber station. Thus, those subscriber units which embody control units which automatically activate the subscriber unit to transmit an alarm message after the elapse of a predetermined duration of time must be switched off when the subscriber is absent from the remote subscriber station to preclude the automatic transmission of a "false" alarm message to the central station.

Thus, it will be appreciated that the capabilities of the system, and in particular the subscriber unit and the portable activator, are not being fully utilized. During those periods of time when the subscriber is absent from the remote subscriber station, the system is effectively inactive, and therefore not being utilized. This reduces the overall efficiency of the system.

SUMMARY OF THE INVENTION

To more fully utilize the capabilities of a personal emergency response system including a remote subscriber station having a subscriber unit interfaced with a communications link, a portable activator which generates an activating signal, and a central station interconnected with the remote subscriber station via the communications link, the present invention is directed to a multi-state selection means which is incorporated with the subscriber unit wherein the subscriber unit is selectively operable in, for example, HOME or AWAY modes. The multi-state selection means is operated by the subscriber to select the desired mode.

In the HOME mode, the subscriber unit of the system is operative in response to a predetermined event to transmit an alarm message notifying the central station that assistance may be required by the subscriber located within the remote subscriber station. The predetermined event activating the subscriber unit may be the elapse of a predetermined period of time and/or the manual operation of the hard-wired and/or portable activator by the subscriber.

In one embodiment of the present invention, the subscriber unit in the AWAY mode is inhibited from activation as a personal emergency response system by the activating signal generated by the portable activator. The subscriber unit of this embodiment is not interfaced with functional subsystems associated with the subscriber station. The activating signal generated by the portable activator, therefore, can be used for command or control purposes, without causing an alarm to be transmitted, to cause a functional subsystem to perform a predetermined function.

In another embodiment of the present invention, the subscriber unit is operatively interfaced with one or more functional subsystems of the remote subscriber station in the AWAY mode to regulate and/or monitor the operation thereof in accordance with a predetermined protocol. For example, the subscriber unit of the present invention may be interfaced with a security subsystem associated with the remote subscriber station in the AWAY mode to automatically monitor the status of the security subsystem. The subscriber unit is automatically activated upon occurrence of a predetermined event to transmit a status message to the central station identifying the predetermined event.

The subscriber unit of the present invention may also be interfaced with one or more electrically/electronically operated or controlled functional subsystems associated with the remote subscriber station in the AWAY mode to regulate the operation of the functional subsystems in accordance with a predetermined protocol. The remote subscriber station may also be interfaced with functional subsystems and/or facilities externally associated with the remote subscriber station to monitor and/or regulate the functional subsystems or facilities in accordance with a predetermined timing protocol as disclosed in the preceding paragraphs.

In the AWAY mode for the embodiment described in the preceding paragraphs, the subscriber unit in the AWAY mode is also inhibited from activation as a personal emergency response system by the activating signal generated by the portable activator. The portable activator, therefore, can be utilized to generate the activating signal which activates the subscriber unit to perform a predetermined function related to the associated functional subsystem. For example, where the subscriber unit is interfaced with a security subsystem in the AWAY mode, the activating signal of the portable activator may be utilized to temporarily deactivate the subscriber unit and the associated security subsystem, thereby permitting the subscriber to enter the subscriber station without activating the security subsystem.

The personal emergency response system of the present invention effectively utilizes the full capability of the subscriber unit and the portable activator. By selective operation of the multi-state selection means to place the subscriber unit in an AWAY mode, the portable activator can be used for command or control purposed to generate an activating signal to cause a functional subsystem to implement a predetermined function. The subscriber unit may also be utilized to perform one or more predetermined monitoring and/or regulating functions for interfaced functional subsystems associated with the subscriber station in accordance with predetermined protocols.

Thus, the personal emergency response system according to the present invention is more fully utilized as a multipurpose system to perform a one or more diverse functions which heretofore have been performed by separate control systems. This results in significant cost savings to the subscriber who avoids the need to purchase a plurality of separate control units and reduces the complexity associated with a number of independent subsystems.

BRIEF DESCRIPTION OF THE DRAWINGS

A more complete understanding of the present invention and the attendant advantages and features thereof will be more readily understood by reference to the following detailed description when considered in conjunction with the accompanying drawings wherein.

DETAILED DESCRIPTION OF PREFERRED EMBODIMENTS

Figure 1:
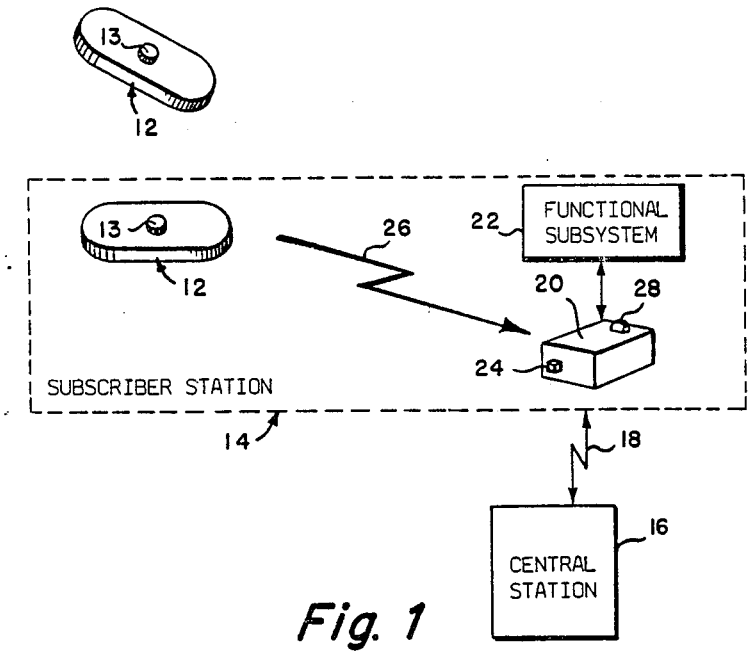
FIG. 1 is a system diagram of a personal emergency response system according to the present invention.

Referring now to the drawings wherein like numerals designate corresponding or similar elements throughout the several views, there is shown in FIG. 1 a diagram exemplifying a personal emergency response system 10 according to the present invention. The system 10 includes a portable activator 12 having an activating means 13, a remote subscriber station 14, a central station 16 and a communications link 18 such as a telephone line interconnecting the remote subscriber station 14 to the central station 16. A subscriber unit 20 is disposed in the remote subscriber station 14 to interface with the communications link 18.

The subscriber unit 20 of the present invention may also be interfaced with one or more functional subsystems 22 associated with the remote subscriber station 14. Conveniently located on the face of the subscriber unit 20 is a multi-state selection means 24. The multi-state selection means 24 is selectively operable by the subscriber to place the subscriber unit 20 in HOME or AWAY modes.

The multi-state selection means 24 may be, for example, a dual or multi-throw mechanical switch wherein one setting places the subscriber unit 20 in the HOME mode and other settings place the subscriber unit 20 in the AWAY mode. In another embodiment, the multi-state selection means 24 is a receiver pretuned to receive selected signals corresponding to the HOME and AWAY modes transmitted by a portable subscriber unit activator. Upon receipt of remotely transmitted selected signals, the subscriber unit 20 is placed in the corresponding HOME or AWAY modes.

In yet another embodiment, the multi-state selection means 24 is coupled to the telephonic communications link 18 of the personal emergency response system 10. The multi-state selection means 24 is designed to be activated after a predetermined number of telephone rings, e.g., 15 rings, and operative in response to predetermined signals transmitted over the telephonic communications link 18 to place the subscriber unit 20 in the corresponding HOME or AWAY modes. By way of example only, the predetermined signals may be generated by selective activation of the touch-tone buttons of the telephone, by use of the portable activator 12 or by an ancillary activating unit (not shown).

Figure 2:
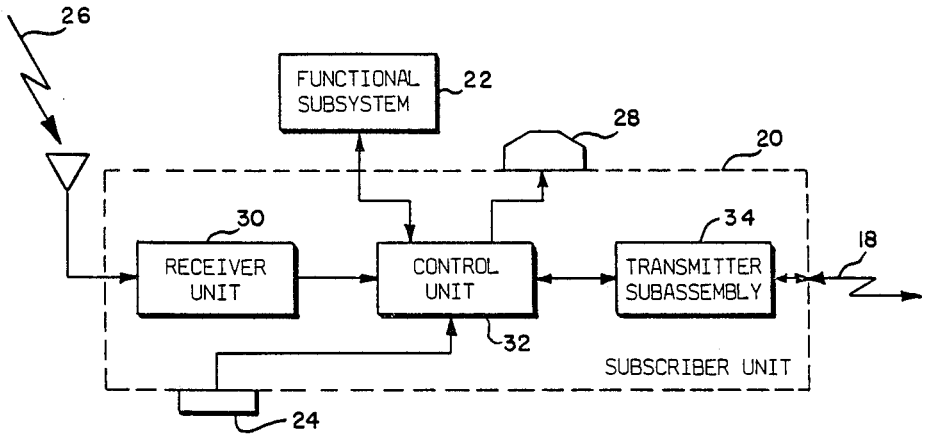
FIG. 2 is a block diagram of an embodiment of a subscriber unit according/to the present invention.

One embodiment of the subscriber unit 20 according to the present invention is depicted in FIG. 2 and includes the multi-mode selection means 24, a local annunciator 28, a receiver unit 30, a control unit 32 such as a microprocessor and transmitter subassembly 34. The control unit 32 of the present invention includes function sets, instructions or protocols corresponding to the HOME and AWAY modes, respectively, which define the operations executed by the subscriber unit 20 for each of the respective modes. The function sets are executable steps in the form of software, hard wiring or other known means for providing operating instructions for the control unit 32.

The control unit 32 may be interfaced with one or more functional subsystems 22 of the remote subscriber station 14 as exemplarily described hereinbelow. It is to be understood that the subscriber unit 20 contains one or more timing/logic circuits (not shown) which may be independent elements or part of the control unit 32 to provide timing protocols for the subscriber unit 20 as required.

The subscriber selectively activates the multi-state selection switch 24 to place the subscriber unit 20 in the HOME or AWAY modes. With the PER system 10 operating in the HOME mode, manual operation of the portable activator 12 generates a signal 26 which is transmitted to the subscriber unit 20 to activate the subscriber unit 20. Alternatively, or in combination, a timing/logic circuit (not shown) may clock a predetermined time interval and activate the subscriber unit 20 upon elapse of the predetermined time interval or a hard-wired activator may generate a signal to activate the subscriber unit 20.

The activated subscriber unit 20 processes the received signal 26 to transmit an alarm signal to the central station 16 via the communications link 18. The alarm message may include remote subscriber station 14 identification data in addition to the alarm data. Concomitantly, the subscriber unit 20 activates the local annunciator 28 to inform the subscriber that the alarm signal has been transmitted.

With respective to the subscriber unit 20 illustrated in FIG. 2 in the HOME mode, the receiver unit 30 is operative to receive the activating signal 26 transmitted by the corresponding portable activator 12. The receiver unit 30 may include a demodulator for systems 10 utilizing a coded activating signal 26, as for example where there are a large number of remote subscriber stations 14 within a small area (e.g., apartment complexes).

A valid activating signal 26 activates the control unit 32 to execute the first function set to implement the overall operation of the subscriber unit 20 in the HOME mode protocol. Alternatively, the control unit 32 may be activated by the timing/logic circuit upon elapse of the predetermined time interval or a signal from the wired-in activator. The control unit 28 governs overall operation by activating the transmitter subassembly 34 to transmit the initial alarm message and any follow-on messages to the central station 16.

The control unit 32 also activates the local annunciator 28 upon transmission of the initial alarm message, thereby advising the subscriber that it has been transmitted. The control unit 32 also causes the transmitter subassembly 34 to receive any messages generated by the central station 16, as for example a reset message which is processed by the control unit 32 to deactivate the local annunciator 28, thereby informing the subscriber that the alarm message has been received by the central station 16.

When the subscriber will be absent from the remote subscriber station 14 for a period of time, the subscriber activates the multi-state selection means 24 to place the subscriber unit 20 in the AWAY mode. This may be accomplished prior to the subscriber exiting the remote subscriber station 14 or after the subscriber has exited the remote subscriber station 14 by use of one of the embodiments of the multi-state selection means 14 described hereinabove. An activating timing/logic circuit may optionally be associated with the control unit 32 to clock a predetermined period of time before the control unit 32 executes the particular function sets or protocols associated with the AWAY mode.

The control unit 32 of a subscriber unit 20 in the AWAY mode may be operative to periodically actuate the local annunciator 28 to generate a perceptible signal. This provides a periodic perceptible signal to the subscriber which indicates that the subscriber unit 20 is operating in the AWAY mode.

While in the AWAY mode, the control unit 32 executes a function set or protocol which disenables or inhibits the subscriber unit 20 to preclude operation thereof as a personal emergency response system in response to any activating signal 26 transmitted by the portable activator 12. Therefore, while in the AWAY mode the subscriber unit 20 cannot transmit an alarm message to the central station 16 in response to any activating signal 26 transmitted by the portable activator 12.

In one embodiment of the present invention, the subscriber unit 20 is not interfaced with any functional subsystems associated with the subscriber station 14. In this embodiment, the subscriber unit 20 in the AWAY mode is not activated to implement any function sets or protocols in response to an activating signal 26 transmitted by the portable activator 12.

In this embodiment, therefore, the portable activator 12 can be utilized for command or control purposes in conjunction with a functional subsystem. The activating signal 26 transmitted by the portable activator 12 causes the functional subsystem to implement a predetermined function. For example, the portable activator 12 may be used to activate/deactivate a lighting system in the subscriber station 14 or to open/close a garage door at the subscriber station 14.

The portable activator 12 of this embodiment may also be utilized to implement a predetermined function in a functional subsystem not associated with the subscriber station 14. For example, the activating signal 26 transmitted by the portable activator 12 may be utilized to activate the horn or lights of a vehicle to assist in locating the vehicle in a crowded parking lot or to provide illumination for safety or security.

In another embodiment of the present invention, placing the subscriber unit 20 in the AWAY mode causes the control unit 32 to be interfaced with one or more functional subsystems 22 associated with the remote subscriber station 14. While in the AWAY mode, the subscriber unit 20 will not implement the function sets or protocols associated with the HOME mode as disclosed hereinabove. The control unit 32 in the AWAY mode executes one or more function sets or protocols to regulate and/or monitor the corresponding interfaced functional subsystems 22. For example, the subscriber unit 20 may be interfaced with a security subsystem 22 protecting the remote subscriber station 14.

The security subsystem 22 may include one or more sensing means such as electric eyes, infrared detectors, interlocking magnetic door/window latches or closed-loop door/window conducting strips disposed to protect the integrity of the remote subscriber substation 14. A predetermined period of time may be clocked by an activating timing/logic circuit, e.g., 40 seconds, to permit the subscriber ample time to exit the remote subscriber station 14 prior to activation of the security subsystem 22*a*. Alternatively, the portable activator 12 may be used to activate the subscriber unit 20 after the subscriber has exited the subscriber station by transmitting the activating signal 26 to the subscriber unit 20.

After elapse of the predetermined time interval or after transmission of the activating signal 26 by the portable activator 12, the control unit 32 executes the function sets associated with the security subsystem 22. The control unit 32 activates the security subsystem 22 and continually monitors the status of the sensing means thereof. In response to a status change in the sensing means, the control unit 32 automatically activates the transmitter assembly 34 to transmit a status message to the central station 16 identifying the changed status of the security subsystem 22. The control unit 32 may also function to activate an audible alarm unit as part of the security subsystem 22.

The subscriber unit 20, for example, may also be interfaced with one or more electrically/electronically operated or controlled functional subsystems 22 associated with the remote subscriber station 14 to regulate the operation thereof. The operation of the functional subsystems 22 may be regulated by activation/deactivation of the functional subsystems 22 and/or varying the operating parameters of the functional subsystems 22. The subsystems 22 may include heating/cooling units, electric switches for indoor/outdoor lights or appliances, an outdoor sprinkler system or a garage door associated with the remote subscriber station 14.

For regulation of functional subsystems 22, the corresponding function sets of the control unit 32 will implement the execution of one or more timing protocols to clock predetermined periods of time for each particular functional subsystem 22. After elapse of a particular predetermined period of time, the control unit 32 effects a change in operating parameters for the corresponding subsystem 22.

For example, the control unit 32 may be interfaced with the remote subscriber station heating/cooling unit 22 to change the temperature within the remote subscriber station 14 in accordance with a predetermined timing/temperature protocol. In this embodiment, for example, the temperature in the remote subscriber station 14 may be lowered to a maximum energy savings level while the subscriber is absent from the remote subscriber station 14 and raised to a comfortable level immediately prior to the projected return of the subscriber to the remote subscriber station 14.

Another function set of the control unit 32 may also be utilized to activate/deactivate electronic/electrical switches in accordance with predetermined timing protocols. For example, the control unit 32 may activate and deactivate indoor light switches and/or appliances in accordance with predetermined timing protocols to create the impression that the subscriber is present in the remote subscriber station 14.

As disclosed hereinabove, the subscriber unit 20 in the AWAY mode will not execute the function set associated with the HOME mode. It will be appreciated, therefore, that the portable activator 12 of the system 10 may be utilized in the AWAY mode to initiate one or more predetermined functions related to the corresponding functional subsystem 22. For example, the activating signal 26 generated by the portable activator 12 may be utilized to temporarily deactivate the subscriber unit 20 in the AWAY mode so that the subscriber may enter the remote subscriber station 14 without activating the security subsystem 22.

The activating signal 26 transmitted by the portable activator 12 with the subscriber unit 20 in the AWAY mode may also be utilized to open a garage door and/or activate selected light switches when the subscriber is in the immediate vicinity of the remote subscriber station 14. It is to be understood that the portable activator 12 may be utilized to effect the performance of one, all or combinations of the foregoing exemplary described activities or other such activities.

While the foregoing discussion regarding the operation of the subscriber unit 20 assumed that the subscriber was absent from the remote subscriber station 14, it will be appreciated that the subscriber unit 20 may be operated in an AWAY mode with the subscriber present in the remote subscriber station 14. For example, the subscriber unit 20 may be utilized to monitor the security subsystem 22 while the subscriber sleeps. The subscriber unit 20 may also be utilized to regulate the heating/cooling unit 22 to effect energy saving temperatures while the subscriber sleeps and to effect a comfortable temperature prior to the subscriber awakening.

In similar manner, the subscriber unit 20 may be utilized to activate light switches and/or appliances such as a coffee maker immediately prior to the awakening of the subscriber. In such AWAY mode operations, function sets may be incorporated in the control unit 32 to permit the subscriber to utilize the portable activator 12 to implement a predetermined function associated with the corresponding functional subsystem 22.

A variety of modifications and variations of the present invention are possible in light of the above teachings. It is therefore to be understood that within the scope of the appended claims, the present invention may be practiced otherwise than as specifically described hereinabove.

What is claimed is:

1. A personal emergency response system including a subscriber station capable of transmitting messages over a communications link to a central station, comprising:

portable activator means selectively operable for generating an activating signal;

functional subsystem means operative in response to said activating signal for performing a predetermined function;

subscriber unit means disposed within the subscriber station and normally operative in response to said activating signal for transmitting one or more messages over the communications link to the central station; and multi-state selection means coupled to said subscriber unit means and selectively actuatable for selectively operating said subscriber unit means in HOME and AWAY modes;

operation of said subscriber unit means in said HOME mode causing said subscriber unit means to be normally operative in response to said activating signal to transmit one or more messages over the communications link to the central station; and operation of said subscriber unit means in said AWAY mode causing activation of the functional subsystem means to perform the predetermined function.

2. The personal emergency response system of claim 1 wherein said multi-state selection means is a dual-throw mechanical switch having first and second settings, said first setting causing said subscriber unit means to operate in said HOME mode and said second setting causing said subscriber unit means to operate in said AWAY mode.

3. The personal emergency response system of claim 1 wherein said multi-state selection means is operative in response to predetermined signals to cause said subscriber unit means to selectively operate in said HOME and AWAY modes.

4. The personal emergency response system of claim 3 wherein said a multi-state selection means is operative in response to predetermined signals from an ancillary portable activator to cause said subscriber unit means to selectively operate in said HOME and AWAY modes.

5. The personal emergency response system of claim 3 wherein said multi-state selection means is operative in response to predetermined signals transmitted over the communications link to cause said subscriber unit means to selectively operate in said HOME and AWAY modes.

6. A personal emergency response system including a subscriber station capable of transmitting messages over a communications link to a central station, comprising:

portable activator means selectively operable for generating an activating signal at the subscriber station;

functional subsystem means associated with the subscriber station for performing at least one function at the subscriber station;

subscriber unit means disposed within the subscriber station and normally operative in response to said activating signal for transmitting one or more messages over the communications link to the central station; and multi-state selection means coupled to said subscriber unit means and selectively actuatable for selectively operating said subscriber unit means in HOME and AWAY modes;

operation of said subscriber unit means in said HOME mode causing said subscriber unit means to be normally operative in response to said activating signal to transmit one or more messages over the communications link to the central station; and operation of said subscriber unit means in said AWAY mode causing said subscriber unit means to be interfaced with the functional subsystem means associated with the subscriber station and activating said subscriber unit means to implement corresponding protocols for controlling operation of the functional subsystem means associated with the subscriber station to perform the at least one function.

7. The personal emergency response system of claim 6 wherein said portable activator means is operative in said AWAY mode to generate said activating signal to cause said subscriber unit to implement a predetermined function at the subscriber station.

8. The personal emergency response system of claim 6 wherein the functional subsystem means is a security subsystem associated with the subscriber station and wherein said subscriber unit means in said AWAY mode is interfaced with the security subsystem for monitoring status changes in the security subsystem and operative in response to changes in status of the security subsystem to transmit a security status change message to the central station via the communications link, and further wherein said portable activator means is operative in said AWAY mode to generate said activating signal to cause said subscriber unit to implement a predetermined function to affect the security subsystem.

9. The personal emergency response system of claim 8 wherein said portable activator means is operative in said AWAY mode to generate said activating signal to cause said subscriber unit to temporarily deactivate the security subsystem at the subscriber station.

10. The personal emergency response system of claim 6 wherein the functional subsystem means is an electrically controlled functional subsystem associated with the subscriber station and wherein said subscriber unit means in said AWAY mode is interfaced with the electrically controlled functional subsystem for activating and deactivating the electrically controlled functional subsystem in accordance with a predetermined timing protocol, and further wherein said portable activator means is operative in said AWAY mode to generate said activating signal to cause said subscriber unit to implement a predetermined function to affect the electrically controlled functional subsystem.

11. The personal emergency response system of claim 6 wherein the functional subsystem means is an electrically controlled functional subsystem associated with the subscriber station and wherein said subscriber unit means in said AWAY mode is interfaced with the electrically controlled functional subsystem for regulating operation of the electrically controlled functional subsystem by varying at least one parameter thereof in accordance with a predetermined timing protocol, and further wherein said portable activator means is operative in said AWAY mode to generate said activating signal to cause said subscriber unit to implement a predetermined function to affect the electrically controlled functional subsystem.

12. The personal emergency response system of claim 6 wherein the functional subsystem means associated with the subscriber station is capable of performing a plurality of functions at the subscriber station and wherein operation of said subscriber unit means in said AWAY mode causes said subscriber unit means to be interfaced with the functional subsystem means for controlling operation of each of the plurality of functions of the functional subsystem means in accordance with each said corresponding protocols, and further wherein said portable activator means is operative in said AWAY mode to generate said activating signal to cause said subscriber unit to implement a predetermined function at the subscriber station.

13. The personal emergency response system of claim 6 wherein said multi-state selection means is a dual-throw mechanical switch having first and second settings, said first setting causing said subscriber unit means to operate in said HOME mode and said second setting causing said subscriber unit means to operate in said AWAY mode.

14. The personal emergency response system of claim 6 wherein said multi-state selection means is operative in response to predetermined signals to cause said subscriber unit means to selectively operate in said HOME and AWAY modes.

15. The personal emergency response system of claim 14 wherein said multi-state selection means is operative in response to predetermined signals from an ancillary portable activator to cause said subscriber unit means to selectively operate in said HOME and AWAY modes.

16. The personal emergency response system of claim 14 wherein said multi-state selection means is operative in response to predetermined signals transmitted over the communications link to cause said subscriber unit means to selectively operate in said HOME and AWAY modes.

* * * * *

UNITED STATES PATENT AND TRADEMARK OFFICE

CERTIFICATE OF CORRECTION

PATENT NO. : 4,884,060

DATED : November 28, 1989

INVENTOR(S) : L. Dennis Shapiro

It is certified that error appears in the above-identified patent and that said Letters Patent is hereby corrected as shown below:

In the Abstract, line 10, "protable" should read --portable--.

In the Abstract, line 17, "cnetral" should read --central--.

In the Abstract, line 21, "remote subscriber to temporarily" should read --remote subscriber station, a portable activator may be operated by the subscriber to temporarily--.

In column 1, lines 7 , "REPORTING VERIFICATION TESTIN" should read --REPORTING VERIFICATION TESTING--.

In column 4, line 20, "subscriber unit according/to" should read --subscriber unit according to--.

Signed and Sealed this

Thirtieth Day of March, 1993

*Attest:*

STEPHEN G. KUNIN

*Attesting Officer*

*Acting Commissioner of Patents and Trademarks*